US009796564B2

(12) United States Patent
Kawai et al.

(10) Patent No.: US 9,796,564 B2
(45) Date of Patent: Oct. 24, 2017

(54) CRANE

(71) Applicants: Kobe Steel, Ltd., Kobe-shi (JP); KOBELCO CRANES CO., LTD., Shinagawa-ku (JP)

(72) Inventors: Hiroaki Kawai, Kobe (JP); Takashi Hiekata, Kobe (JP); Koji Inoue, Kobe (JP); Shintaro Sasai, Hyogo (JP); Toshiro Yamashita, Hyogo (JP); Koichi Shimomura, Tokyo (JP); Tetsuya Ogawa, Hyogo (JP)

(73) Assignees: Kobe Steel, Ltd., Kobe-shi (JP); KOBELCO CRANES CO., LTD., Shinagawa-ku (JP)

( * ) Notice: Subject to any disclaimer, the term of this patent is extended or adjusted under 35 U.S.C. 154(b) by 75 days.

(21) Appl. No.: 15/055,721

(22) Filed: Feb. 29, 2016

(65) Prior Publication Data

US 2016/0257534 A1 Sep. 8, 2016

(30) Foreign Application Priority Data

Mar. 2, 2015 (JP) ..... 2015-040097
Dec. 22, 2015 (JP) ..... 2015-249847

(51) Int. Cl.
*B66C 13/16* (2006.01)
*B66C 13/50* (2006.01)
(Continued)

(52) U.S. Cl.
CPC ..... *B66C 13/50* (2013.01); *B66C 13/22* (2013.01); *B66C 15/00* (2013.01); *B66C 23/905* (2013.01)

(58) Field of Classification Search
CPC ..... B66C 13/16; B66C 13/22; B66C 13/50; B66C 15/00; B66C 15/06; B66C 15/065; B66C 23/90; B66C 23/905
See application file for complete search history.

(56) References Cited

U.S. PATENT DOCUMENTS

2002/0040609 A1* 4/2002 Kiviniitty ..... B66C 23/905 73/862.393
2008/0019815 A1* 1/2008 Harris ..... B66C 23/80 414/563

(Continued)

FOREIGN PATENT DOCUMENTS

JP 2002-211884 7/2002

*Primary Examiner* — Emmanuel M Marcelo
(74) *Attorney, Agent, or Firm* — Oblon, McClelland, Maier & Neustadt, L.L.P.

(57) ABSTRACT

A crane includes an overload safety device and a identifying unit. The overload safety device includes a maximum-load calculating unit configured to calculate a maximum load that a winch drum is capable of winding up with driving torques output from the remaining electric motors other than a failed electric motor identified by the identifying unit, an updating unit configured to update a set hoisting ability value stored in a storing unit to a value equal to the maximum load, and a control unit configured to cause the remaining electric motors to operate when a value of a load derived by a load deriving unit is equal to or smaller than a latest set hoisting ability value stored in the storing unit and stop the operation of the plurality of electric motors when the value of the load derived by the load deriving unit exceeds the latest set hoisting ability value.

4 Claims, 11 Drawing Sheets

(51) Int. Cl.

| | |
|---|---|
| ***B66C 13/22*** | (2006.01) |
| ***B66C 15/00*** | (2006.01) |
| ***B66C 23/90*** | (2006.01) |

(56) References Cited

U.S. PATENT DOCUMENTS

| | | | | |
|---|---|---|---|---|
| 2008/0169131 | A1* | 7/2008 | Takeda | E02F 9/26 177/136 |
| 2008/0215700 | A1* | 9/2008 | Pillar | A62C 27/00 709/212 |
| 2013/0253759 | A1* | 9/2013 | Matsumoto | B66C 23/905 701/31.1 |
| 2015/0362450 | A1* | 12/2015 | Lehtinen | B66B 19/02 187/391 |

* cited by examiner

CRANE

TECHNICAL FIELD

The present invention relates to a crane.

BACKGROUND ART

Conventionally, an overload safety device for preventing an overload from being applied during hoisting work has been mounted on a crane. Japanese Unexamined Patent Publication No. 2002-211884 discloses an example of the overload safety device.

The overload safety device disclosed in Japanese Unexamined Patent Publication No. 2002-211884 includes storing means in which a plurality of kinds of work performance corresponding to a plurality of states of a crane during hoisting work are stored. The storing means stores work performance of each of states during respective kinds of work such as jib work, boom work, and boom with jib work. Jib work is work for, in a state in which a jib is attached to a boom so as to extend from a boom distal end, hoisting a hoisted load from the distal end of the jib. The boom work is work for, in a state in which the jib is stored so as to extend along the boom, hoisting the hoisted load from the distal end of the boom. The boom with jib work is work for, in a state in which the jib is attached to the boom so as to extend from the boom distal end, hoisting the hoisted load from the distal end of the boom.

In the overload safety device, a state during the hoisting work of the crane is derived on the basis of a kind of work manually set using work setting means and a detection result by jib-storage detecting means for detecting whether the jib is in a stored state. Work performance corresponding to the derived state is selected from the plurality of kinds of work performance stored in the storing means. A limit value corresponding the length of the boom and detection values of a derricking angle and a slewing angle of the boom is calculated on the basis of the selected work performance. When a detected value of a load acting on the boom reaches the limit value, the overload safety device regulates operations of driving sections of the crane to thereby prevent an overload from being applied.

As explained above, in the overload safety device disclosed in Japanese Unexamined Patent Publication No. 2002-211884, a limit value is not uniformly set and a limit value corresponding to each of states during the hoisting work of the crane is set. Therefore, the crane can exhibit as high hoisting abilities as possible in the states during the hoisting work.

Incidentally, some crane is mounted with, as a winch for hoisting work, a winch configured to rotate a winch drum with a plurality of electric motors and perform winding-up and winding-down of a hoisted load. In the winch for the hoisting work, it is assumed that a failure occurs in any one of the plurality of electric motors. In this case, a hoisting ability of the crane is deteriorated compared with a hoisting ability at the time when all the electric motors are normally operating without failing.

However, in the conventional overload safety device, the deterioration in the hoisting ability due to the failure of the electric motor of the winch for hoisting work is not assumed. Therefore, when the overload safety device is used in the crane mounted with the winch for hoisting work, it is likely that the hoisting work is performed in a state in which application of a load (a hoisting load) exceeding the hoisting ability deteriorated by the failure of the electric motor is allowed. That is, certainty of overload prevention is spoiled.

On the other hand, when the certainty of the overload prevention is considered important, it is also conceivable to cause the overload safety device to immediately stop the operation of all the electric motors by reducing a set hoisting ability value (a limit value), which is a determination reference for overload prevention, to 0 at a point in time when any one of the plurality of electric motors fails. However, in this case, even if the remaining electric motors other than the failed electric motor are normally operable, the operation of the remaining electric motors is also stopped. That is, even if a certain degree of hoisting ability can be exhibited by rotating the winch drum with the normally operable remaining electric motors, the hoisting work cannot be carried out at all.

SUMMARY OF INVENTION

It is an object of the present invention to make it possible to continuously carry out hoisting work in a possible range while securing certainty of overload prevention even if any one of a plurality of electric motors fails in a crane in which a winch drum for the hoisting work is rotated by the plurality of electric motors.

A crane according to an aspect of the present invention is a crane which performs winding-up and winding-down of a target object including: a winch drum configured to rotate for the winding-up and the winding-down of the target object; a plurality of electric motors configured to be operated by supply of electric power to output respective driving torques for rotating the winch drum; a load deriving unit configured to derive a value of a load of the target object, the load being a load applied to the winch drum; an overload safety device configured to monitor the value of the load derived by the load deriving unit and stop an operation of each of the plurality of electric motors when the value of the load exceeds a set hoisting ability value of the crane to stop the rotation of the winch drum; and a identifying unit configured to identify a failed electric motor among the plurality of electric motors. The overload safety device includes: a storing unit configured to store the set hoisting ability value; a maximum-load calculating unit configured to calculate a maximum load which the winch drum is capable of winding up with the driving torques output from the remaining electric motors other than the failed electric motor identified by the identifying unit; an updating unit configured to update the set hoisting ability value stored in the storing unit to a value equal to the maximum load calculated by the maximum-load calculating unit; and a control unit configured to perform control of the plurality of electric motors. The control unit performs control for stopping the operation of the failed electric motor identified by the identifying unit, causing the remaining electric motors to operate when the value of the load derived by the load deriving unit is equal to or smaller than a latest set hoisting ability value stored in the storing unit, and stopping the operation of the plurality of electric motors when the value of the load derived by the load deriving unit exceeds the latest set hoisting ability value.

DESCRIPTION OF EMBODIMENTS

An embodiment of the present invention is explained below with reference to the drawings.

Figure 1:
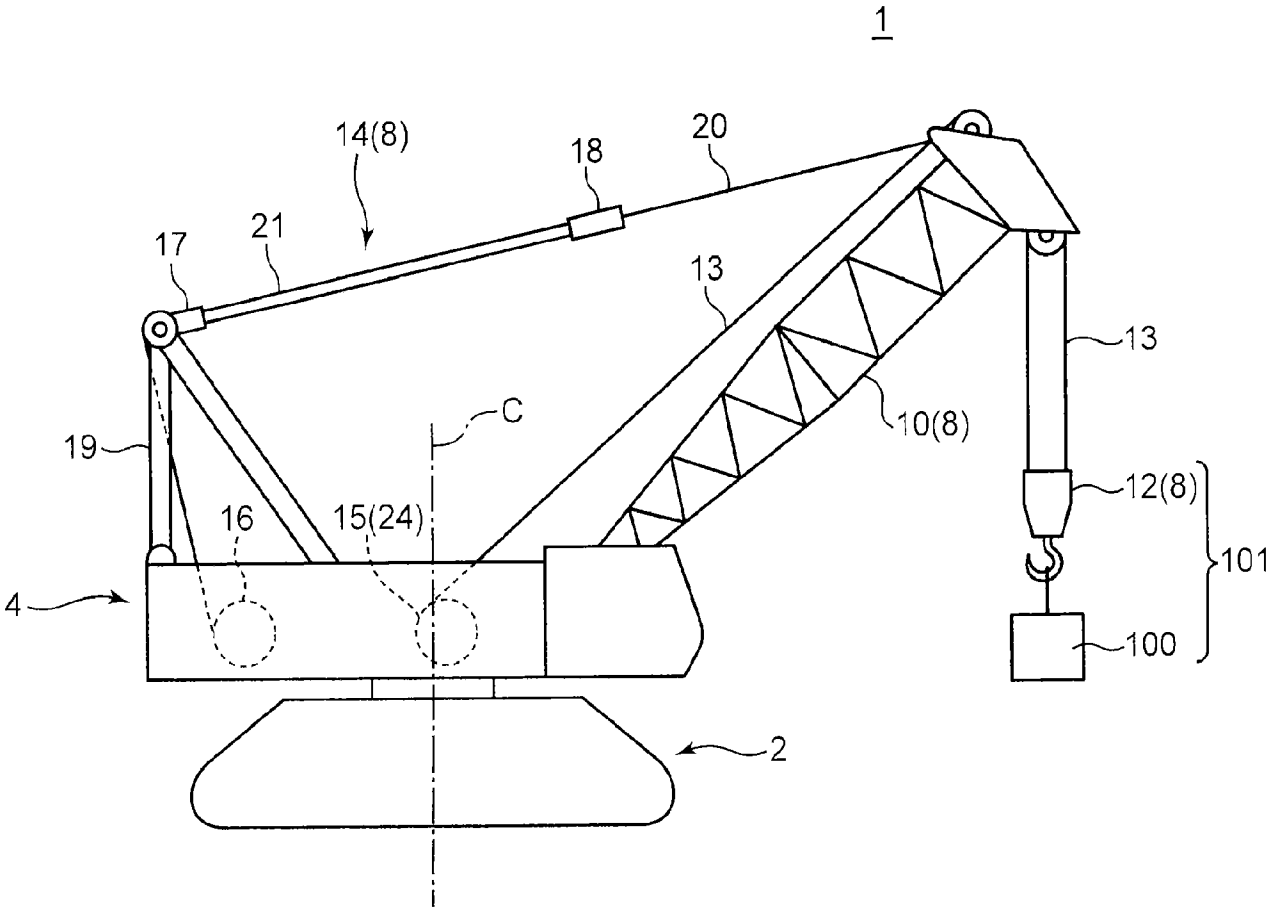
FIG. 1 is a schematic side view of a crane according to an embodiment of the present invention.

A crane according to the embodiment of the present invention includes, as shown in FIG. 1, a lower traveling body 2 capable of self-traveling and an upper slewing body 4 mounted on the lower traveling body 2 to be capable of slewing around a slewing center axis C.

The upper slewing body 4 is provided with a work apparatus 8 that performs hoisting work of a hoisted load 100, that is, crane work. The work apparatus 8 includes a boom 10, a hook device 12, a derricking device 14, and a winding-up winch 15.

The boom 10 is provided in the upper slewing body 4 to be capable of derricking with a boom foot (not shown in the figure) of a base end section of the boom 10 as a fulcrum. The hook device 12 is configured to hoist the hoisted load 100. The hook device 12 is hung down from the distal end of the boom 10 via a hoisting rope 13. Note that a target object 101 wound up and wound down in hoisting work by the crane according to this embodiment includes a hook device 12 and the hoisted load 100 hoisted by the hook device 12.

The derricking device 14 includes a derricking winch 16, a lower spreader 17, an upper spreader 18, a gantry 19, and a guy rope 20.

The lower spreader 17 is provided at the upper end portion of the gantry 19 erected in a rear part of the upper slewing body 4. The upper spreader 18 is provided to be spaced apart from the lower spreader 17. A derricking rope 21 drawn out from the derricking winch 16 is wound around a sheave of the lower spreader 17 and a sheave of the upper spreader 18. The guy rope 20 connects the upper spreader 18 and the distal end portion of the boom 10. The derricking winch 16 changes an interval between the upper spreader 18 and the lower spreader 17 by performing winding and feeding of the derricking rope 21 to thereby derrick the boom 10 via the guy rope 20.

The winding-up winch 15 is mounted on the upper slewing body 4. The hoisting rope 13 drawn out from the winding-up winch 15 is connected to the hook device 12 through the distal end of the boom 10. The winding-up winch 15 performs winding-up and winding-down of the hook device 12 by performing winding and feeding of the hoisting rope 13 to thereby perform winding-up and winding-down of the target object 101.

Specifically, the winding-up winch 15 is an electric winch. The winding-up winch 15 includes a winch drum 24 (hereinafter simply referred to as drum 24), a plurality of electric motors 26 (see FIG. 2), a torque transmitting device 28 (see FIG. 2), and a plurality of mechanical brakes 30 corresponding to the plurality of electric motors 26.

The drum 24 is configured to rotate to wind up and wind down the target object 101. Specifically, the drum 24 winds the hoisting rope 13 by rotating in a winding-up direction, which is one rotating direction, to thereby wind up the target object 101. The drum 24 feeds the hoisting rope 13 by rotating in a winding-down direction, which is a rotating direction opposite to the winding-up direction, to thereby wind down the target object 101.

The plurality of electric motors 26 (see FIG. 2) are electrically connected to a power supply 29 mounted on the crane. The electric motors 26 is operated by supply of electric power from the power supply 29 to thereby output respective driving torques for rotating the drum 24. In this embodiment, the winding-up winch 15 includes two electric motors 26. One electric motor of the two electric motors 26 is referred to as first electric motor 31 and the other electric motor is referred to as second electric motor 32.

The torque transmitting device 28 (see FIG. 2) combines the driving torques which are respectively output from the plurality of electric motors 26 and transmits the combined driving torques to the drum 24. Specifically, the torque transmitting device 28 is connected to a driving shaft 31*a* of the first electric motor 31 and a driving shaft 32*a* of the second electric motor 32. Consequently, the driving torques of the electric motors 31 and 32 are input from the driving shafts 31*a* and 32*a* thereof to the torque transmitting device 28. The torque transmitting device 28 combines the driving torques input from the driving shafts 31*a* and 32*a*. The torque transmitting device 28 is connected to a rotating shaft 24*a* of the drum 24. Consequently, the torque transmitting device 28 applies the combined driving torque to the rotating shaft 24*a*. That is, driving torque obtained by combining the driving torque output from the first electric motor 31 and the driving torque output from the second electric motor 32 is input to the rotating shaft 24*a* of the drum 24. Consequently, the drum 24 rotates.

The mechanical brakes 30 are respectively attached to the electric motors 26 corresponding thereto. In this embodiment, the winding-up winch 15 includes two mechanical brakes 30. One of the two mechanical brakes 30 is attached to the first electric motor 31, and the other is attached to the second electric motor 32. One mechanical brake attached to the first electric motor 31 is referred to as first mechanical brake 33. The other mechanical brake attached to the second electric motor 32 is referred to as second mechanical brake 34.

The first mechanical brake 33 is configured to be switchable to a lock state and an unlock state. The lock state is a state in which the first electric motor 31 is braked such that the first electric motor 31 is kept in an operation stop state. The unlock state is a state in which the braking of the first electric motor 31 is released to enable the first electric motor 31 to operate.

Specifically, in the lock state, the first mechanical brake 33 fixes the driving shaft 31*a* of the first electric motor 31 to prevent the driving shaft 31*a* from rotating. In the unlock state, the first mechanical brake 33 releases the fixing of the driving shaft 31*a* to enable the driving shaft 31*a* to rotate. The first mechanical brake 33 is controlled to be switched to the lock state and the unlock state by a control unit 63 explained below of an overload safety device 48. Specifically, the first mechanical brake 33 is put into the unlock state according to an input of a control signal, which is an electric signal, from the control unit 63. On the other hand, the first mechanical brake 33 is put into the lock state according to a stop of the input of the control signal from the control unit 63.

The second mechanical brake 34 is configured to be switchable to a lock state and an unlock state. The lock state is a state in which the second electric motor 32 is braked such that the second electric motor 32 is kept in the operation stop state. The unlock state is a state in which the braking of the second electric motor 32 is released to enable the second electric motor 32 to operate.

Specifically, in the lock state, the second mechanical brake 34 fixes the driving shaft 32*a* of the second electric motor 32 not to rotate. In the unlock state, the second mechanical brake 34 releases the fixing of the driving shaft 32*a* to enable the driving shaft 32*a* to rotate. The second mechanical brake 34 is controlled to be switched to the lock state and the unlock state by the control unit 63 of the overload safety device 48. Specifically, the second mechanical brake 34 is put into the unlock state according to an input of a control signal, which is an electric signal, from the control unit 63. On the other hand, the second mechanical brake 34 is put into the lock state according to a stop of the input of the control signal from the control unit 63.

Figure 2:
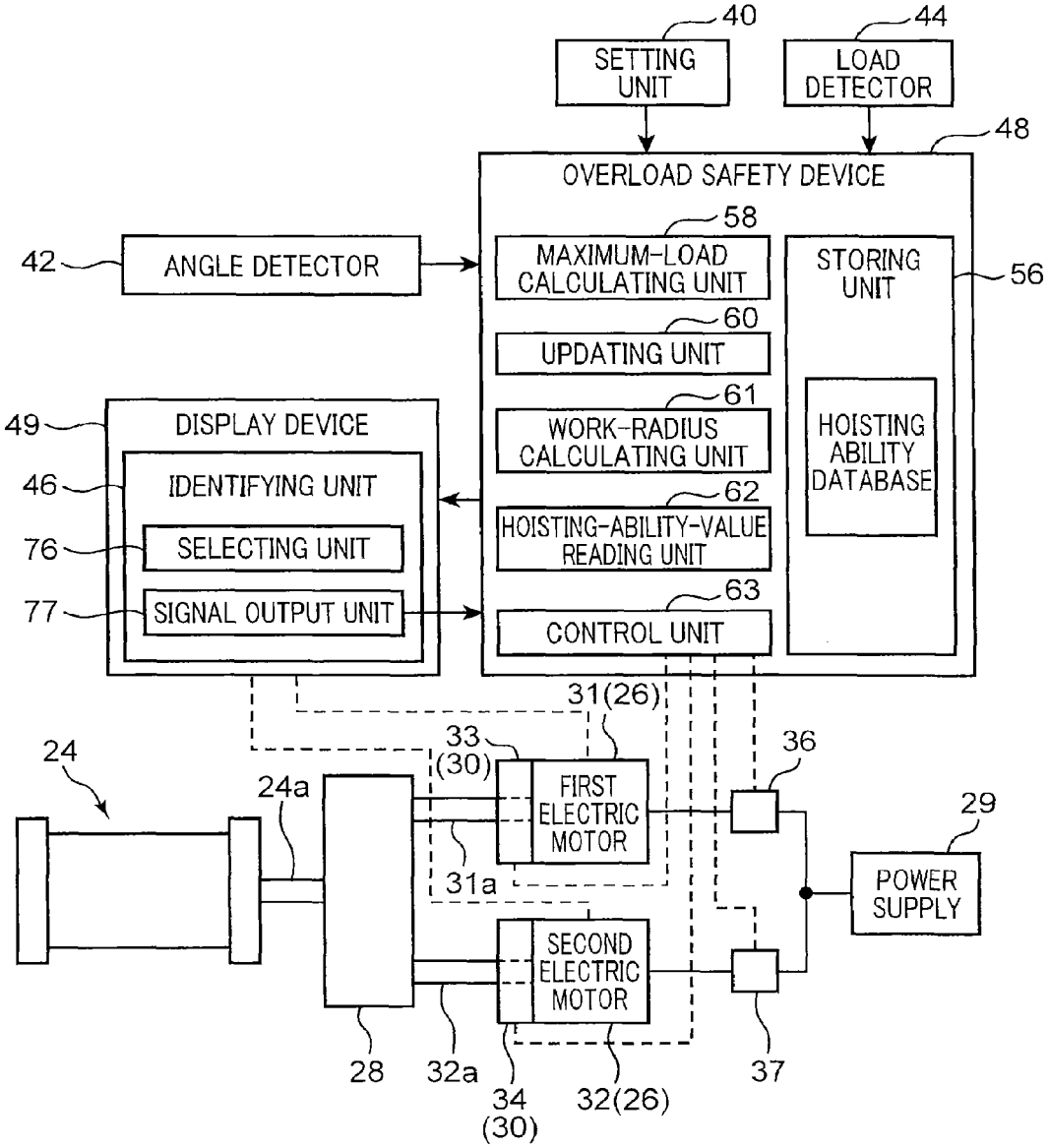
FIG. 2 is a schematic diagram showing a system configuration of the crane according to the embodiment of the present invention.

The crane according to this embodiment includes, as shown in FIG. 2, a first switch 36, a second switch 37, a setting unit 40, an angle detector 42, a load detector 44, an identifying unit 46, the overload safety device 48, and a display device 49.

The first switch 36 is provided on an electric path between the power supply 29 and the first electric motor 31. The first switch 36 is switched to an ON state and an OFF state. The ON state is a state in which the power supply 29 and the first electric motor 31 are connected to allow supply of electric power from the power supply 29 to the first electric motor 31. The OFF state is a state in which the connection between the power supply 29 and the first electric motor 31 is cut off to stop the supply of the electric power from the power supply 29 to the first electric motor 31. The first switch 36 is controlled to be switched to the ON state and the OFF state by the control unit 63 of the overload safety device 48.

The second switch 37 is provided on an electric path between the power supply 29 and the second electric motor 32. The second switch 37 is switched to an ON state and an OFF state. The ON state is a state in which the power supply 29 and the second electric motor 32 are connected to allow supply of electric power from the power supply 29 to the second electric motor 32. The OFF state is a state in which the connection between the power supply 29 and the second electric motor 32 is cut off to stop the supply of the electric power from the power supply 29 to the second electric motor 32. The second switch 37 is controlled to be switched to the ON state and the OFF state by the control unit 63 of the overload safety device 48.

The setting unit 40 is a unit for inputting various setting values concerning the crane. Specifically, the length in the axial direction of the boom 10 (see FIG. 1), that is, the distance from the boom foot to the distal end of the boom 10 and other setting values are input by the setting unit 40. Data of the setting values input by the setting unit 40 is input to the overload safety device 48 (see FIG. 2).

The angle detector 42 is a detector that detects a derricking angle of the boom 10 (see FIG. 1). Specifically, the angle detector 42 continuously detects a derricking angle, which is an angle formed by the boom 10 with respect to a surface orthogonal to the slewing center axis C of the upper slewing body 4. The angle detector 42 successively outputs data of the detected derricking angle of the boom 10 to the overload safety device 48 (see FIG. 2).

The load detector 44 is an example of the load deriving unit in the present invention. The load detector 44 detects a load of the target object 101 (see FIG. 1) applied to the drum 24. Specifically, the hoisting rope 13 is connected to the load detector 44. The load detector 44 continuously detects a load applied to the drum 24 from the hoisting rope 13. The load detector 44 successively outputs data of the detected load value to the overload safety device 48.

The identifying unit 46 is a unit for identifying a failed electric motor 26 of the plurality of electric motors 26. That is, when one or both of the first electric motor 31 and the second electric motor 32 fail, the failed electric motors are identified by the identifying unit 46. In this embodiment, since the identifying unit 46 is incorporated in the display device 49, the specific configuration of the identifying unit 46 is explained together with the display device 49.

The overload safety device 48 monitors a value of a load detected by the load detector 44. If the value of the load detected by the load detector 44 exceeds a set hoisting ability value of the crane, the overload safety device 48 stops the operation of the electric motors 26 to stop the rotation of the drum 24, to thereby stop winding-up or winding-down the target object 101. The overload safety device 48 includes, as shown in FIG. 2, a storing unit 56, a maximum-load calculating unit 58, an updating unit 60, a work-radius calculating unit 61, a hoisting-ability-value reading unit 62 and the control unit 63, functioning as a functional blocks.

Figure 3:
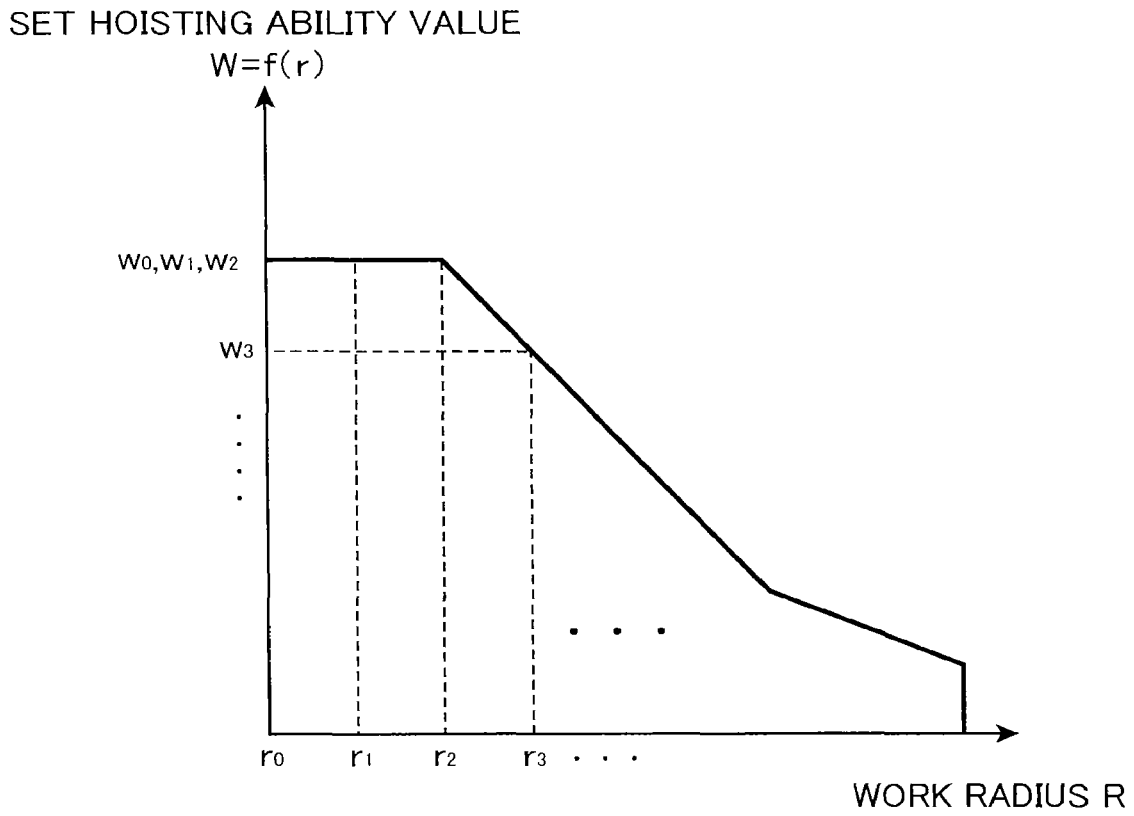
FIG. 3 is a diagram showing a correlation between a work radius and a set hoisting ability value registered in a hoisting ability database.

The storing unit 56 stores the various setting values input from the setting unit 40, a specified value, and the set hoisting ability value of the crane. The set hoisting ability value is represented by a load value of the target object 101 (see FIG. 1) hoisted by the crane. The set hoisting ability value is set to as large a load value as possible in a range in which the boom 10 (see FIG. 1) can withstand in terms of strength and a range in which safety against overturning of the crane is not spoiled. As shown in FIG. 2, the storing unit 56 stores the set hoisting ability value in a form of a hoisting ability database. The hoisting ability database is a database that specifies a correspondence relation between a work radius R of the crane at every predetermined interval and a set hoisting ability value W. For example, as shown in FIG. 3, set hoisting ability values $w_0$, $w_1$, $w_2$, $w_3$, . . . corresponding to work radiuses $r_0$, $r_1$, $r_2$, $r_3$, . . . at every predetermined interval are specified in the hoisting ability database.

The maximum-load calculating unit 58 (see FIG. 2) calculates a maximum load that the drum 24 is capable of winding up when driving torque output from the remaining electric motor 26 other than the failed electric motor 26 identified by the identifying unit 46 is applied to the drum 24.

In response to the identifying of the failed electric motor 26 by the identifying unit 46, the updating unit 60 updates the set hoisting ability value of the hoisting ability database stored in the storing unit 56 to a value equal to the maximum load calculated by the maximum-load calculating unit 58.

The work-radius calculating unit 61 successively calculates a work radius during hoisting work of the crane on the basis of the length of the boom 10 stored in the storing unit 56, the distance from the slewing center axis C on the surface orthogonal to the slewing center axis C of the upper slewing body 4 to a part of the upper stewing body 4 where the boom foot is supported and the derricking angle of the boom 10 input to the overload safety device 48 from the angle detector 42. The distance from the slewing center axis C to the part of the upper slewing body 4 where the boom foot is supported is the specified value stored in the storing unit 56.

The hoisting-ability-value reading unit 62 successively reads out, from the latest hoisting ability database stored in the storing unit 56, a set hoisting ability value corresponding to the work radius successively calculated by the work-radius calculating unit 61. Note that, when the work radius calculated by the work-radius calculating unit 61 is a value between adjacent two work radiuses among work radiuses registered in the hoisting ability database, the hoisting-ability-value reading unit 62 reads set hoisting ability values corresponding to the two work radiuses from the latest hoisting ability database and calculates, from the read set hoisting ability values, according to an interpolation operation, a set hoisting ability value corresponding to the work radius calculated by the work-radius calculating unit 61.

The control unit 63 performs control for allowing the operation of the electric motors 26 and control for stopping the operation of the electric motors 26.

Specifically, if the failed electric motor 26 is not identified by the identifying unit 46, that is, in the case of a normal state in which none of the plurality of electric motors 26 is out of order, the control unit 63 allows the operation of all of the electric motors 26 if a detection value of a load input to the overload safety device 48 from the load detector 44 is equal to or smaller than the set hoisting ability value read by the hoisting-ability-value reading unit 62 at that point in time. On the other hand, if the failed electric motor 26 is not identified by the identifying unit 46, the control unit 63 stops the operation of all of the electric motors 26 if the detection value of the load input to the overload safety device 48 from the load detector 44 exceeds the set hoisting ability value read by the hoisting-ability-value reading unit 62 at that point in time.

If the failed electric motor 26 is identified by the identifying unit 46, the control unit 63 stops the identified electric motor 26. If the remaining electric motor 26 other than the electric motor 26 identified by the identifying unit 46 is present in this case, that is, if the electric motor 26 not out of order and in the normal state is present, the control unit 63 allows the operation of the remaining electric motor 26 if the detection value of the load input to the overload safety device 48 from the load detector 44 is equal to or smaller than the set hoisting ability value read by the hoisting-ability-value reading unit 62 at that point in time. On the other hand, if the remaining electric motor 26 is present, the control unit 63 stops the operation of the remaining electric motor 26 if the detection value of the load input to the overload safety device 48 from the load detector 44 exceeds the set hoisting ability value read by the hoisting-ability-value reading unit 62 at that point in time.

If allowing the operation of the first electric motor 31 of the electric motors 26, the control unit 63 changes the first switch 36 to the ON state to cause the power supply 29 to supply electric power to the first electric motor 31 and inputs a control signal to the first mechanical brake 33 to put the first mechanical brake 33 into the unlock state. Consequently, the control unit 63 causes the first electric motor 31 to operate. If stopping the operation of the first electric motor 31, the control unit 63 changes the first switch 36 to the OFF state to stop the supply of the electric power from the power supply 29 to the electric motor 31 and stops the input of the control signal to the first mechanical brake 33 to put the first mechanical brake 33 into the lock state. Consequently, the control unit 63 stops the operation of the first electric motor 31.

If allowing the operation of the second electric motor 32 of the electric motors 26, the control unit 63 changes the second switch 37 to the ON state to cause the power supply 29 to supply electric power to the second electric motor 32 and inputs a control signal to the second mechanical brake 34 to put the second mechanical brake 34 into the unlock state. Consequently, the control unit 63 causes the second electric motor 32 to operate. If stopping the operation of the second electric motor 32, the control unit 63 changes the second switch 37 to the OFF state to stop the supply of the electric power from the power supply 29 to the second electric motor 32 and stops the input of the control signal to the second mechanical brake 34 to put the second mechanical brake 34 into the lock state. Consequently, the control unit 63 stops the operation of the second electric motor 32.

The control unit 63 transmits a control signal for instructing the ON state or the OFF state to the first switch 36 and the second switch 37. The switches 36 and 37 change to the ON state or the OFF state according to the control signal received from the control unit 63.

Figure 4:
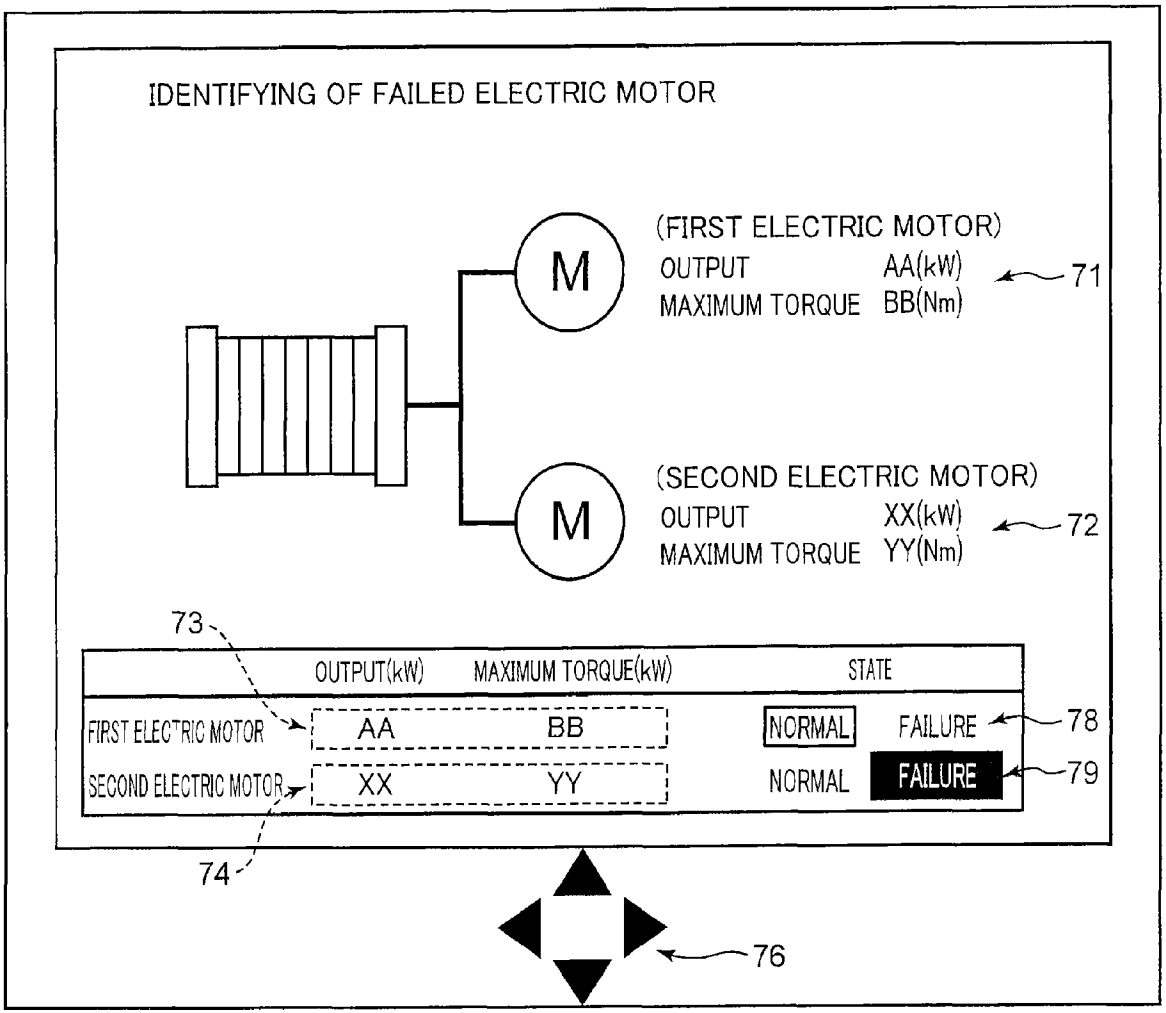
FIG. 4 is a diagram showing an example of an identifying screen for a failed electric motor of a display device.
Figure 5:
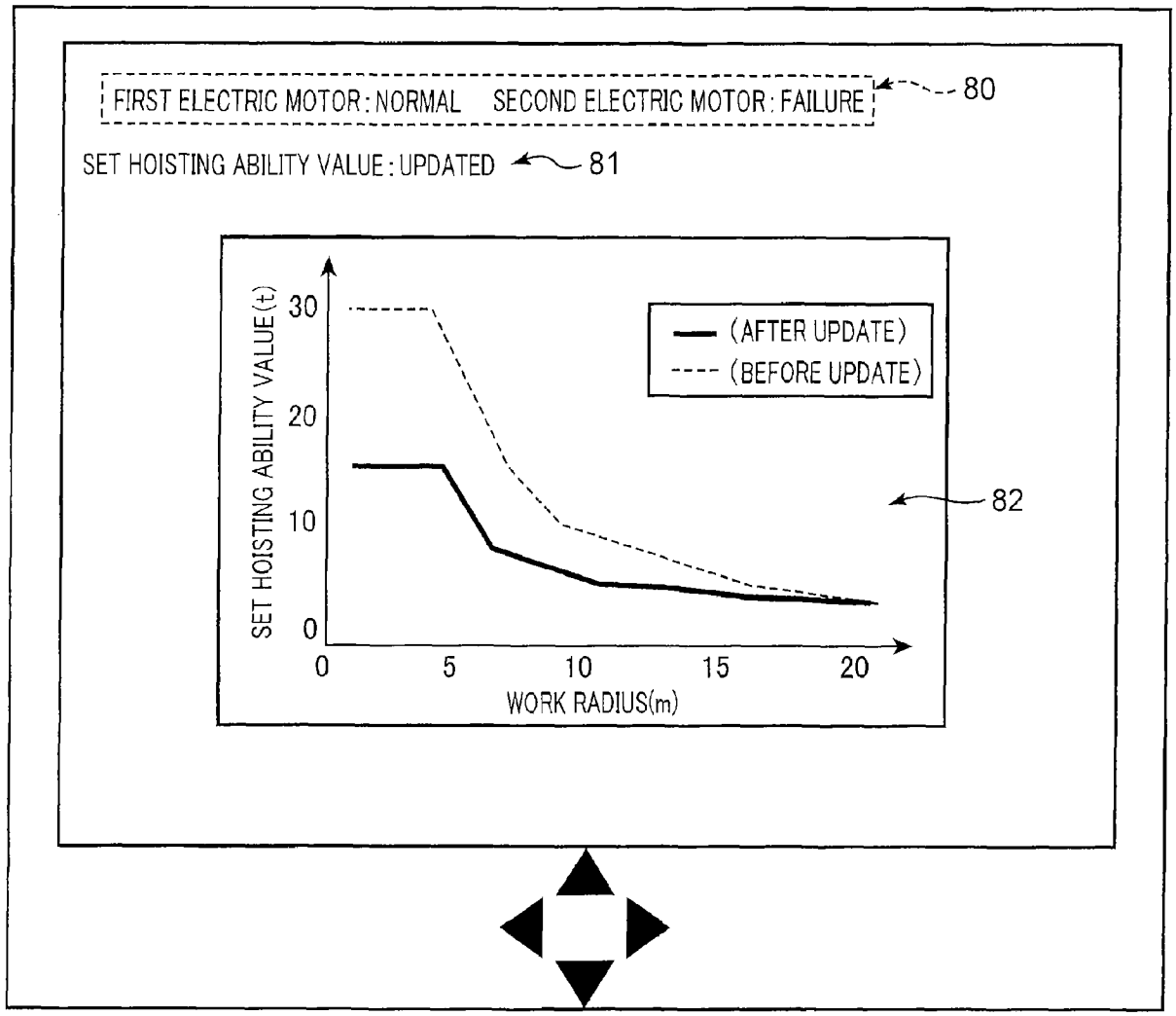
FIG. 5 is a diagram showing an example of an update informing screen for a set hoisting ability value of the display device.
Figure 6:
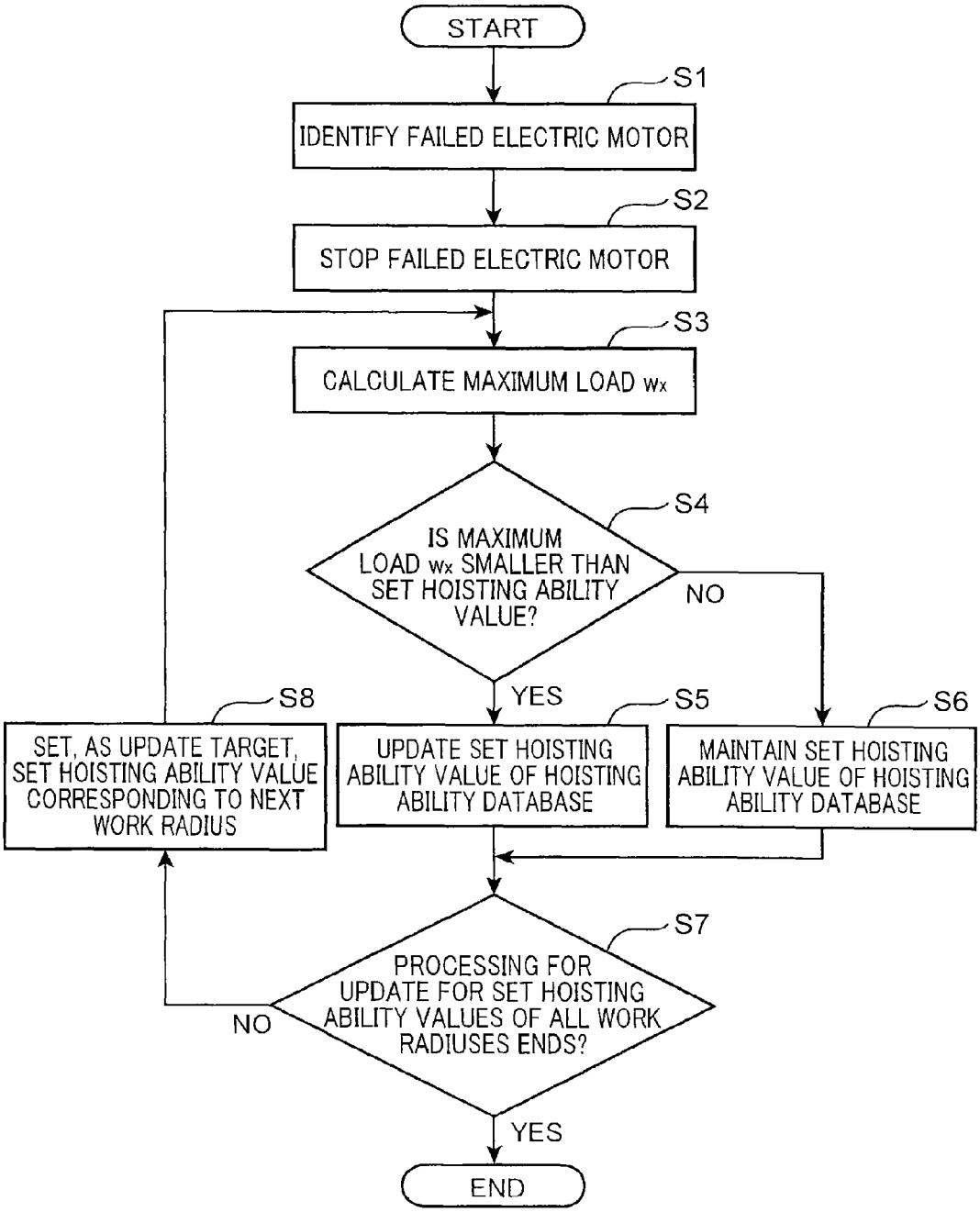
FIG. 6 is a flowchart for explaining a processing process at the time when a failure occurs in any electric motor of a winding-up winch in the crane according to the embodiment of the present invention.

The display device 49 displays various states of the crane on a screen thereof. The display device 49 is an example of an informing unit of the present invention. Information concerning outputs and maximum torques of the electric motors 26 (the first electric motor 31 and the second electric motor 32) is successively input to the display device 49 from the electric motors. The display device 49 switches and displays a identifying screen (see FIG. 4) for a failed electric motor and an update informing screen (see FIG. 5) for a set hoisting ability value. The identifying screen for the failed electric motor is a screen used by an operator of the crane to identify the failed electric motor 26. The update informing screen for the set hoisting ability value is a screen for informing the operator that the set hoisting ability value of the hoisting ability database stored in the storing unit 56 is updated.

The identifying screen (see FIG. 4) for the failed electric motor includes a first present state display field 71, a second present state display field 72, a first specification display field 73, and a second specification display field 74.

The first present state display field 71 is a part where an actual output and actual maximum torque in the present state of the first electric motor 31 are displayed. The second present state display field 72 is a part where an actual output and actual maximum torque in the present state of the second electric motor 32 are displayed. The display device 49 displays, in the first present state display field 71, a value of an output and a value of maximum torque corresponding to the information concerning the output and the maximum torque input from the first electric motor 31. The display device 49 displays, in the second present state display field 72, a value of an output and a value of maximum torque corresponding to the information concerning the output and the maximum torque input from the second electric motor 32.

The first specification display field 73 is a part where an output and maximum torque specified as specifications of the first electric motor 31 are displayed. The second specification display field 74 is a part where an output and maximum torque specified as specifications of the second electric motor 32 are displayed. An output value and a value of maximum torque of the first electric motor 31 specified as specifications and an output value and a value of maximum torque of the second electric motor 32 specified as specifications are input to the display device 49 in advance. The display device 49 displays, in the first specification display field 73, the output value and the value of the maximum torque of the first electric motor 31 specified as the specifications input to the display device 49 in advance. The display device 49 displays, in the second specification display field 74, the output value and the value of the maximum torque of the second electric motor 32 specified as the specifications input to the display device 49 in advance.

As shown in FIG. 2, the identifying unit 46 is incorporated in the display device 49. The identifying unit 46 includes a selecting unit 76 provided on the identifying screen (see FIG. 4) for the failed electric motor and a signal output unit 77 incorporated in the display device 49.

The selecting unit 76 (see FIG. 4) is operated by the operator on the identifying screen of the failed electric motor in order to select the electric motor 26 in the failure state. The operator can move, by operating the selecting unit 76, cursors in a state display field 78 of the first electric motor 31 and a state display field 79 of the second electric motor 32 and thereby select the failure state or the non-failure normal state as states of the electric motors 31 and 32.

If the actual output of the first electric motor 31 displayed in the first present state display field 71 (see FIG. 4) is smaller than the output of the specifications of the first electric motor 31 displayed in the first specification display field 73 (see FIG. 4) and a difference between the outputs exceeds a predetermined threshold, the operator determines that the first electric motor 31 has failed. In this case, the operator operates the selecting unit 76 to select the failure state as the state of the first electric motor 31. If the actual maximum torque of the first electric motor 31 displayed in the first present state display field 71 is smaller than the maximum torque of the specifications of the first electric motor 31 displayed in the first specification display field 73 and a difference between the maximum torques exceeds a predetermined threshold, the operator also determines that the first electric motor 31 has failed. In this case, the operator also operates the selecting unit 76 to select the failure state as the state of the first electric motor 31. If both of the actual output and the actual maximum torque of the first electric motor 31 are not smaller than the corresponding values of the specifications with differences equal to or larger than the thresholds, the operator selects the normal state as the state of the first electric motor 31.

Concerning the second electric motor 32, the operator performs determination same as the determination for the first electric motor 31 on the basis of the outputs and the maximum torques respectively displayed in the second present state display field 72 and the second specification display field 74 and selects the state of the second electric motor 32 with the selecting unit 76.

The signal output unit 77 outputs a signal indicating the states of the first electric motor 31 and the second electric motor 32 selected by the operation of the selecting unit 76 to the overload safety device 48.

A state display field 80 and an update-information display field 81 are provided in an upper part of the update informing screen (see FIG. 5) for the set hoisting ability value. The state display field 80 is a part where the states (the normal state or the failure state) of the first and second electric motors 31 and 32 are displayed. The update-information display field 81 is a part where it is indicated whether the set hoisting ability value is updated. On the update informing screen, a comparison display unit 82 for displaying, side by side, a correlation between a set hoisting ability value and a work radius equivalent to the hoisting ability database before update and a correlation between a set hoisting ability value and a work radius equivalent to the hoisting ability database after the update is provided.

The display device 49 displays the state of the first electric motor 31 in the state display field 80 according to the state of the first electric motor 31 selected by the operation of the selecting unit 76 and displays the state of the second electric motor 32 in the state display field 80 according to the state of the second electric motor 32 selected by the operation of the selecting unit 76.

In response to the update, by the updating unit 60, of the set hoisting ability value of the hoisting ability database stored in the storing unit 56, a signal for notification of the update is input to the display device 49 from the overload safety device 48. In response to the update of the set hoisting ability value by the updating unit 60, that is, in response to the input of the signal for notification of the update from the overload safety device 48, the display device 49 performs, in the update-information display field 81, display of "updated" representing that the set hoisting ability value has been updated. In response to the update of the set hoisting ability value by the updating unit 60, the display device 49 displays, in the comparison display unit 82, a correlation between the set hoisting ability value before the update and the work radius and a correlation between the set hoisting ability value after the update and the work radius.

A processing process performed when a failure occurs in the electric motor 26 in the crane according to this embodiment is explained.

First, a failed electric motor of the plurality of electric motors 26 of the winding-up winch 15 is identified by the identifying unit 46 (step S1).

Specifically, the operator of the crane individually determines states of the first electric motor 31 and the second electric motor 32 while viewing the first and second present state display fields 71 and 72 and the first and second specification display fields 73 and 74 displayed on the identifying screen for the failed electric motor of the display device 49. Note that, in this embodiment, it is assumed that a failure occurs in the second electric motor 32 of the first and second electric motors 31 and 32 and an output and/or maximum torque of the second electric motor 32 decreases.

As a result of the occurrence of the failure in the second electric motor 32, an actual output of the second electric motor 32 displayed in the second present state display field 72 is smaller than the output of the specifications displayed in the second specification display field 74 and a difference between the outputs exceeds the predetermined threshold, and actual maximum torque of the second electric motor 32 displayed in the second present state display field 72 is smaller than the maximum torque of the specifications displayed in the second specification display field 74 and a difference between the maximum torques exceeds the predetermined threshold. The operator views situations of the output and the maximum torque of the second electric motor 32 and determines that the second electric motor 32 has failed. The operator operates the selecting unit 76 to thereby move the cursor in the state display field 79 of the second electric motor 32 to the failure state to thereby identify that the second electric motor 32 is in the failure state.

In response to the identifying by the operator, a signal indicating that the second electric motor 32 is in the failure state is output from the signal output unit 77 to the overload safety device 48. The first electric motor 31 is in the non-failure normal state. It is identified that the first electric motor 31 is in the normal state in the state display field 78 of the first electric motor 31. Therefore, a signal indicating that the first electric motor 31 is in the normal state is output from the signal output unit 77 to the overload safety device 48.

Subsequently, the control unit 63 stops the operation of the failed electric motor 26 identified by the identifying unit 46 (step S2). Specifically, when the second electric motor 32 is identified to be in the failure state and the signal indicating that the second electric motor 32 is in the failure state is input to the overload safety device 48, the control unit 63 stops the operation of the second electric motor 32. At this point, the control unit 63 stops the supply of the electric power from the power supply 29 to the second electric motor 32 by changing the second switch 37 to the OFF state to thereby stop the operation of the second electric motor 32. On the other hand, the first electric motor 31 is in the normal state and the signal indicating to that effect is input from the signal output unit 77 to the overload safety device 48. Therefore, the control unit 63 allows the operation of the first electric motor 31 according to the signal.

Thereafter, a series of processing (steps S3 to S8) for update of the set hoisting ability value of the hoisting ability database stored in the storing unit 56 is performed.

First, the maximum-load calculating unit 58 calculates a maximum load $w_x$ that the drum 24 is capable of winding up with driving torque output from the remaining electric motor 26 other than the electric motor 26 in the failure state identified by the identifying unit 46 (step S3). Specifically, when only the maximum torque of the specifications of the first electric motor 31 in the normal state is applied to the drum 24, the maximum-load calculating unit 58 calculates the maximum load $w_x$ that the drum 24 is capable of winding up.

Subsequently, the control unit 63 determines whether the maximum load $w_x$ calculated by the maximum-load calculating unit 58 is smaller than a set hoisting ability value corresponding to a predetermined work radius of the hoisting ability database stored in the storing unit 56 (step S4). The control unit 63 determines whether the maximum load $w_x$ is smaller than a set hoisting ability value $w_0$ corresponding to the smallest work radius $r_0$ among the work radiuses registered in the hoisting ability database.

If the control unit 63 determines that the maximum load $w_x$ is smaller than the set hoisting ability value $w_0$, subsequently, the updating unit 60 updates the set hoisting ability value $w_0$ corresponding to the work radius $r_0$ of the hoisting ability database stored in the storing unit 56 to a value equal to the maximum load $w_x$ (step S5).

On the other hand, if the control unit 63 determines that the maximum load $w_x$ is not smaller than the set hoisting ability value $w_0$, that is, equal to or larger than the set hoisting ability value $w_0$, the updating unit 60 maintains the set hoisting ability value $w_0$ corresponding to the work radius $r_0$ of the hoisting ability database stored in the storing unit 56 without updating the set hoisting ability value $w_0$ (step S6).

After step S5 or S6, the control unit 63 determines whether the processing in steps S4 to S6 for update of the set hoisting ability values $w_0$, $w_1$, $w_2$, $w_3$, . . . of all of the work radiuses $r_0$, $r_1$, $r_2$, $r_3$, . . . registered in the hoisting ability database ends (step S7).

If determining that the processing in steps S4 to S6 does not end for the set hoisting ability values of all of the work radiuses yet, that is, the set hoisting ability values of the work radiuses for which the processing in steps S4 to S6 is not performed are present, the control unit 63 sets, as an update target, the set hoisting ability value corresponding to the next work radius that has not been processed (step S8). That is, since the set hoisting ability value $w_0$ corresponding to the work radius $r_0$ is set as the update target in the above steps S4 to S6, in step S8, the control unit 63 sets, as the update target, the set hoisting ability value $w_1$ corresponding to the smallest work radius $r_1$ among the unprocessed work radiuses.

Thereafter, the processing in step S3 and subsequent steps is repeatedly performed. As a result, for the work radiuses registered in the hoisting ability database, the processing for the update of the set hoisting ability value is performed in order from the smallest work radius.

If the control unit 63 determines in step S7 that the processing in steps S4 to S6 ends for the set hoisting ability values $w_0$, $w_1$, $w_2$, $w_3$, . . . of all of the work radiuses $r_0$, $r_1$, $r_2$, $r_3$, . . ., the series of processing for the update of the set hoisting ability value of the hoisting ability database stored in the storing unit 56 ends.

In this embodiment, if the electric motor 26 in the failure state is identified by the identifying unit 46, the maximum load that the drum 24 is capable of winding up with the driving torque output from the remaining electric motor 26 in the normal state other than the identified electric motor 26 in the failure state is calculated by the maximum-load calculating unit 58. The set hoisting ability value of the hoisting ability database stored in the storing unit 56 is updated to a value equal to the maximum load calculated by the maximum-load calculating unit 58. If the load value detected by the load detector 44 exceeds the corresponding set hoisting ability value of the latest hoisting ability database stored in the storing unit 56, the control unit 63 stops the operation of the electric motors 26. As a result, the rotation of the drum 24 is stopped. Therefore, it is possible to secure certainty of overload prevention at the time when any one of the plurality of electric motors 26 fails.

On the other hand, if the load value detected by the load detector 44 is equal to or smaller than the corresponding set hoisting ability value of the latest hoisting ability database stored in the storing unit 56, the control unit 63 causes the remaining electric motor 26 in the normal state other than the electric motor 26 in the failure state to operate. Therefore, it is possible to rotate the drum 24 with the driving torque output from the remaining electric motor 26. That is, according to the update of the set hoisting ability value of the hoisting ability database, although a hoisting ability is limited compared with the case of a normal state in which none of the electric motors 26 is out of order, it is possible to continuously carry out the hoisting work with a maximum limit hoisting ability in a possible range specified by the set hoisting ability value of the hoisting ability database after the update.

In this embodiment, according to the update, by the updating unit 60, of the set hoisting ability value of the hoisting ability database stored in the storing unit 56, in the update-information display field 81 of the update informing screen for the set hoisting ability value, the display device 49 displays that the set hoisting ability value of the hoisting ability database is updated. Therefore, viewing the display, the operator can learn that the update of the set hoisting ability value has been performed.

The display device 49 displays the states (the normal state or the failure state) of the electric motors 31 and 32 in the state display field 80 of the update informing screen. Therefore, viewing the display, the operator can confirm that the failure has occurred in the first electric motor 31 or the second electric motor 32. Therefore, it is possible to prevent the operator from forgetting to perform repair and maintenance of the failed electric motor.

The display device 49 displays, side by side, a correlation between the work radius and the set hoisting ability value of the hoisting ability database before the update and a correlation between the work radius and the set hoisting ability value of the hoisting ability database after the update in the comparison display unit 82 of the update informing screen. Therefore, viewing the display of the comparison display unit 82, the operator can learn to what degree the set hoisting ability value after the update has decreased from the set hoisting ability value before the update. Therefore, the operator can select hoisting of the hoisted load 100 having a load not exceeding the set hoisting ability value after the update in the hoisting work by the crane.

Note that the embodiment disclosed herein should be considered illustrative and not limiting in all respects. The scope of the present invention is indicated by the claims rather than the explanation of the embodiment explained above, and includes all changes within a meaning and a scope equivalent to those of the claims.

For example, three or more electric motors that output driving torques for rotating the drum may be provided.

The informing unit according to the present invention is not always limited to the display device that informs the operator, with the screen display, of the update of the set hoisting ability value stored in the storing unit. For example, it is possible to adopt, as the informing unit according to the present invention, a device that informs the operator of the update with sound, a lamp that informs the operator of the update with lighting or flashing, and other devices.

The identifying unit according to the present invention does not always have to be incorporated in the display device. That is, the identifying unit may be provided separately from the display device.

The identifying unit according to the present invention is not always limited to the identifying unit with which, as in the embodiment, the operator of the crane determines whether the state of the electric motor is the normal state or the failure state and, if the state of the electric motor is the failure state, operates the selecting unit to thereby identify the state of the electric motor as the failure state.

For example, the identifying unit may be a identifying unit that has a function of automatically determining whether the state of the electric motor is the normal state or the failure state and identifies the failed electric motor among the plurality of electric motors without depending on the determination of the operator.

Figure 7:
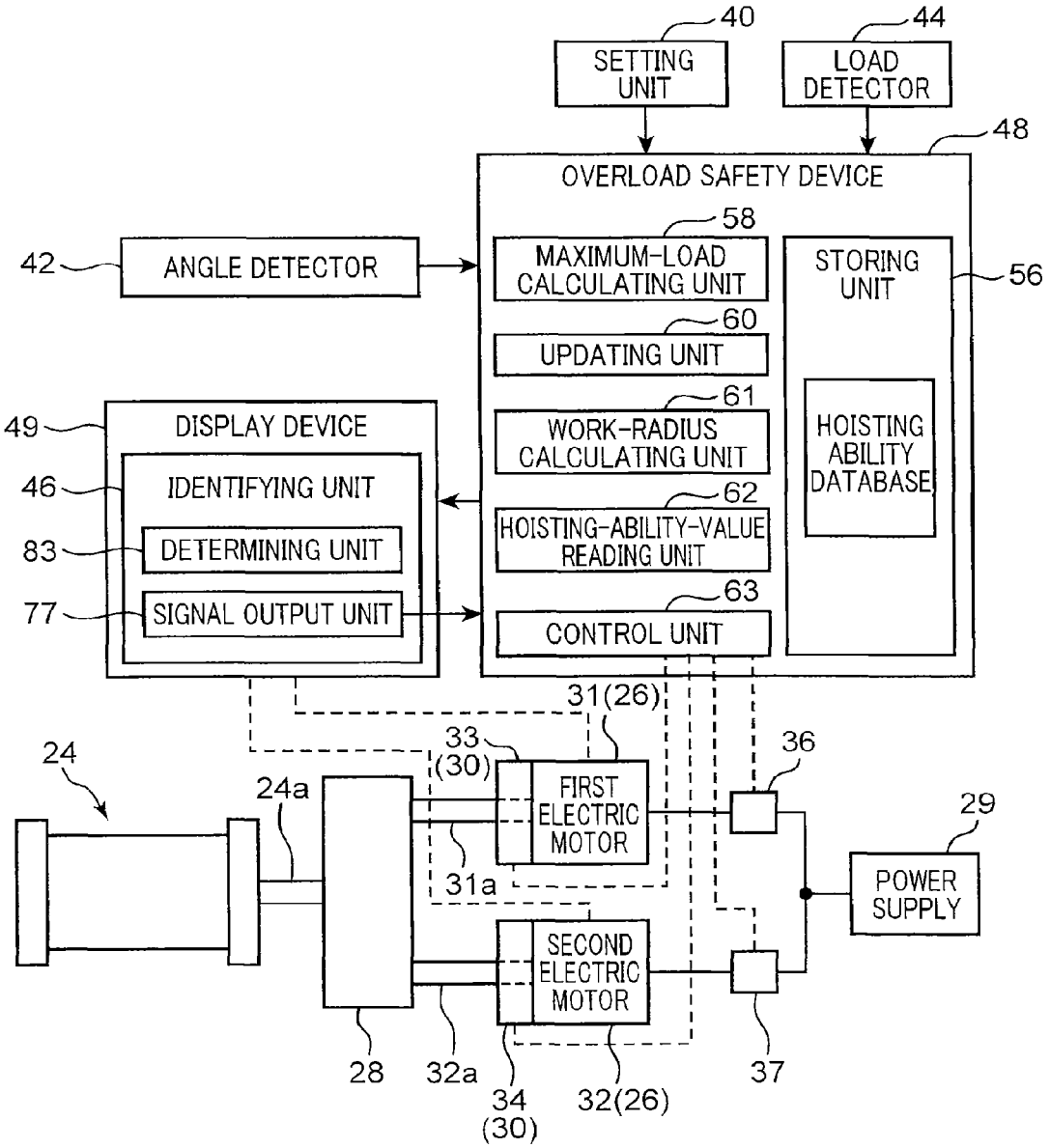
FIG. 7 is a schematic diagram showing a system configuration of a crane according to a first modification of the embodiment of the present invention.

Specifically, as in a system configuration of a first modification shown in FIG. 7, the identifying unit 46 only has to include, instead of the selecting unit 76, a determining unit 83 that automatically determines whether the state of the electric motor 26 is the normal state or the failure state.

The determining unit 83 monitors actual outputs and maximum torques of the first and second electric motors 31 and 32. If detecting that the actual outputs of the electric motors 31 and 32 are smaller than the corresponding outputs of the specifications and differences between the actual outputs and the outputs of the specifications exceed the predetermined threshold or detecting that the actual maximum torques of the electric motors 31 and 32 are smaller than the corresponding maximum torques of the specifications and differences between the actual maximum torques and the maximum torques of the specifications exceed the predetermined threshold, the determining unit 83 determines that the electric motors 31 and 32 are in the failure state. On the other hand, if detecting that the actual outputs of the electric motors 31 and 32 have not decreased to a degree at which the differences between the actual outputs of the electric motors 31 and 32 and the corresponding outputs of the specifications are equal to or larger than the predetermined threshold and the actual maximum torques of the electric motors 31 and 32 have not decreased to a degree at which the differences between the actual maximum torques of the electric motors 31 and 32 and the corresponding maximum torques of the specifications are equal to or larger than the predetermined threshold, the determining unit 83 determines that the electric motors 31 and 32 are in the non-failure normal state. That is, on behalf of the operator, the determining unit 83 automatically performs the determination which is performed by the operator when identifying the failed electric motor 26 in the above embodiment.

In the first modification, if the determining unit 83 determines that the first electric motor 31 is in the failure state, the signal output unit 77 outputs a signal indicating that the first electric motor 31 is in the failure state, to the overload safety device 48 according to the determination. If the determining unit 83 determines that the first electric motor 31 is in the non-failure normal state, the signal output unit 77 outputs a signal indicating that the first electric motor 31 is in the normal state, to the overload safety device 48 according to the determination. Similarly, concerning the second electric motor 32, the signal output unit 77 outputs a signal indicating that the second electric motor 32 is in the failure state or the normal state, to the overload safety device 48 according to the determination of the determining unit 83. In the overload safety device 48, processing same as the processing in the embodiment is performed.

In the first modification, according to the determination of the determining unit 83, the display device 49 automatically displays the states (the normal state or the failure state) of the first and second electric motors 31 and 32 in the state display field 80 of the update informing screen (see FIG. 5) for the set hoisting ability value. As in the case of the embodiment, in response to the update of the set hoisting ability value of the hoisting ability database, the display device 49 displays that the update is performed and comparatively displays a correlation between the work radius and the set hoisting ability value of the hoisting ability database before the update and a correlation between the work radius and the set hoisting ability value of the hoisting ability database after the update.

In response to the first modification, even if the operator does not determine whether the electric motor 26 has failed, the electric motor 26 in the failure state is automatically identified and the set hoisting ability value of the hoisting ability database is automatically updated. Therefore, the operator can concentrate on the operation of the crane for the hoisting work.

In response to the update of the set hoisting ability value of the hoisting ability database, the display device 49 displays that the set hoisting ability value of the hoisting ability database is updated, in the update-information display field 81 of the update informing screen for the set hoisting ability value. Therefore, viewing the display, the operator can learn that the update of the set hoisting ability value has been performed.

As in the embodiment, according to the display of the comparison display unit 82 of the update informing screen, the operator can learn to what degree the set hoisting ability value after the update has decreased from the set hoisting ability value before the update.

According to the update of the set hoisting ability value of the hoisting ability database, the display device 49 displays the states (the normal state or the failure state) of the electric motors 31 and 32 in the state display field 80 of the update informing screen. Therefore, viewing the display, the operator can recognize that a failure has occurred in the first electric motor 31 or the second electric motor 32. Therefore, it is possible to prevent the operator from forgetting to perform repair and maintenance of the failed electric motor.

Figure 8:
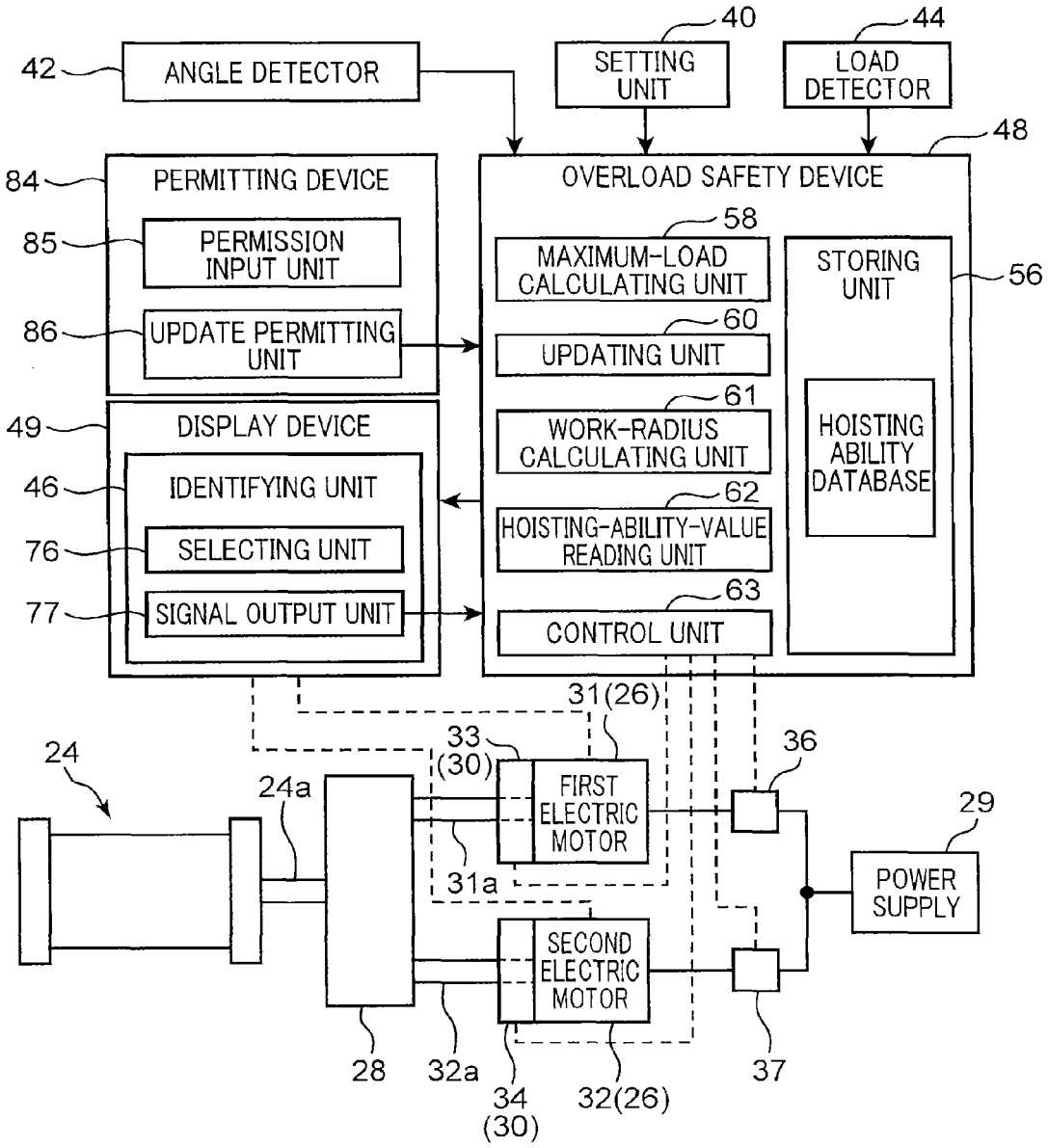
FIG. 8 is a schematic diagram showing a system configuration of a crane according to a second modification of the embodiment of the present invention.

As a second modification, a configuration may be adopted in which, even if the failed electric motor 26 is identified by the identifying unit 46, the update of the set hoisting ability value of the hoisting ability database stored in the storing unit 56 is not performed if the operator does not permit update. A system configuration of a crane according to the second modification is shown in FIG. 8.

In the second modification, the crane includes a permitting device 84 used by the operator to permit the update of the set hoisting ability value by the updating unit 60. The permitting device 84 includes a permission input unit 85 for receiving an input of an instruction for permitting the update of the set hoisting ability value and an update permitting unit 86 that grants permission for the update of the set hoisting ability value to the updating unit 60 according to the input of the instruction to the permission input unit 85.

The permission input unit 85 is, for example, a switch operated by the operator to permit the update of the set hoisting ability value. The operation of the switch by the operator is equivalent to the input of the instruction for permitting the update.

The update permitting unit 86 transmits a permission signal representing the permission of the update, to the overload safety device 48 in response to the input of the instruction for permitting the update to the permission input unit 85. The transmission of the permission signal is equivalent to the granting of the permission for the update of the set hoisting ability value to the updating unit 60.

In response to the identifying of the failed electric motor 26 by the identifying unit 46 and the granting of the permission for the update from the update permitting unit 86 (that is, in response to the input of the permission signal to the overload safety device 48), the updating unit 60 updates the set hoisting ability value of the hoisting ability database stored in the storing unit 56.

Figure 9:
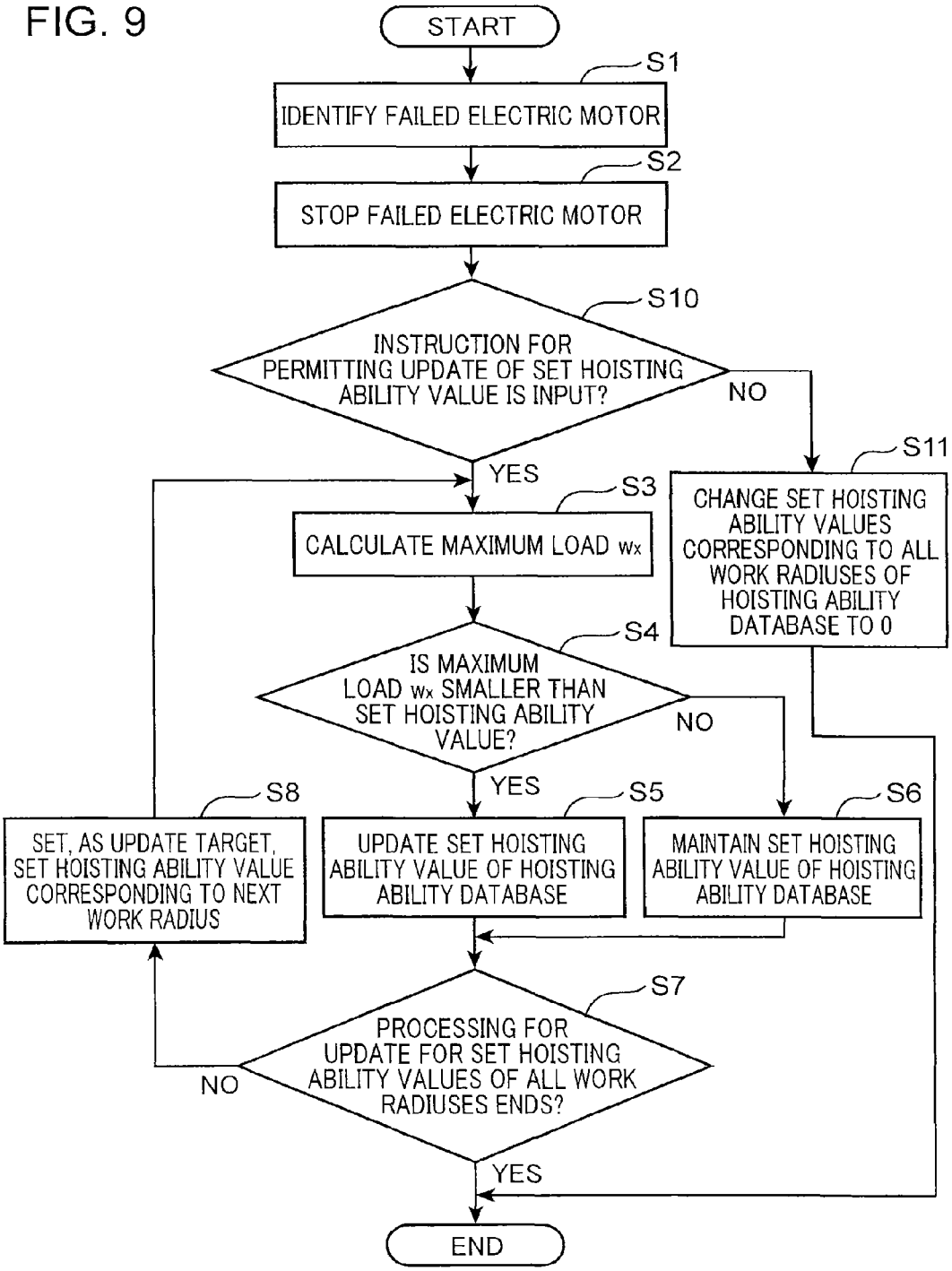
FIG. 9 is a flowchart for explaining a processing process at the time when a failure occurs in any electric motor of a winding-up winch in the crane according to the second modification.

In FIG. 9, a flowchart of a processing process performed when a failure occurs in the electric motor 26 in the second modification is shown.

Specifically, the processing process in the second modification is equivalent to a processing process in which processing in step S10 and step S11 is added to the processing process in the embodiment.

Specifically, in the second modification, after the control unit 63 stops the operation of the failed electric motor 26 in step S2, in step S10, the control unit 63 determines whether an instruction for permitting the update of the set hoisting ability value is input to the permission input unit 85. Specifically, the control unit 63 determines whether the permission signal is input from the update permitting unit 86 to the overload safety device 48.

If the control unit 63 determines in step S10 that the instruction for permitting the update of the set hoisting ability value is input to the permission input unit 85, that is, the permission signal is input to the overload safety device 48, subsequently, the calculation of the maximum load $w_x$ by the maximum-load calculating unit 58 in step S3 is performed. Thereafter, processing related to the update of the set hoisting ability value of the hoisting ability database stored in the storing unit 56 is performed.

On the other hand, if the control unit 63 determines in step S10 that the instruction for permitting the update of the set hoisting ability value is not input to the permission input unit 85, that is, the permission signal is not input to the overload safety device 48, subsequently, the processing in step S11 by the updating unit 60 is performed.

In step S11, the updating unit 60 changes the set hoisting ability values $w_0, w_1, w_2, w_3, \ldots$ corresponding to all of the work radiuses $r_0, r_1, r_2, r_3, \ldots$ of the hoisting ability database stored in the storing unit 56 to 0. After step S11, the processing for the update of the set hoisting ability value of the hoisting ability database ends.

In the second modification, even if the electric motor 26 in the failure state is identified, if the operator does not input the instruction for permitting the update of the set hoisting ability value to the permission input unit 85, the set hoisting ability value of the hoisting ability database stored in the storing unit 56 is not updated to a value equal to the maximum load $w_x$ that the drum 24 is capable of winding up with the driving torque output from the electric motor 26 in the non-failure normal state. That is, the operator can perform permission for changing the set hoisting ability value of the hoisting ability database to the value equal to the maximum load $w_x$ at the operator's own will if the electric motor 26 in the failure state is identified. Therefore, the operator can surely recognize that the set hoisting ability value has been changed to the value equal to the maximum load $w_x$.

In the second modification, after the electric motor 26 in the failure state is identified, if the operator does not input the instruction for permitting the update of the set hoisting ability value to the permission input unit 85, the set hoisting ability values corresponding to all of the work radiuses of the hoisting ability database stored in the storing unit 56 are changed to 0. Therefore, the electric motor 26 in the normal state, which is not identified as being in the failure state by the identifying unit 46 and continues to operate, is also stopped by the control unit 63. Therefore, even if the operator forgets to input the instruction for permitting the update of the set hoisting ability value, it is possible to surely prevent an overload.

Figure 10:
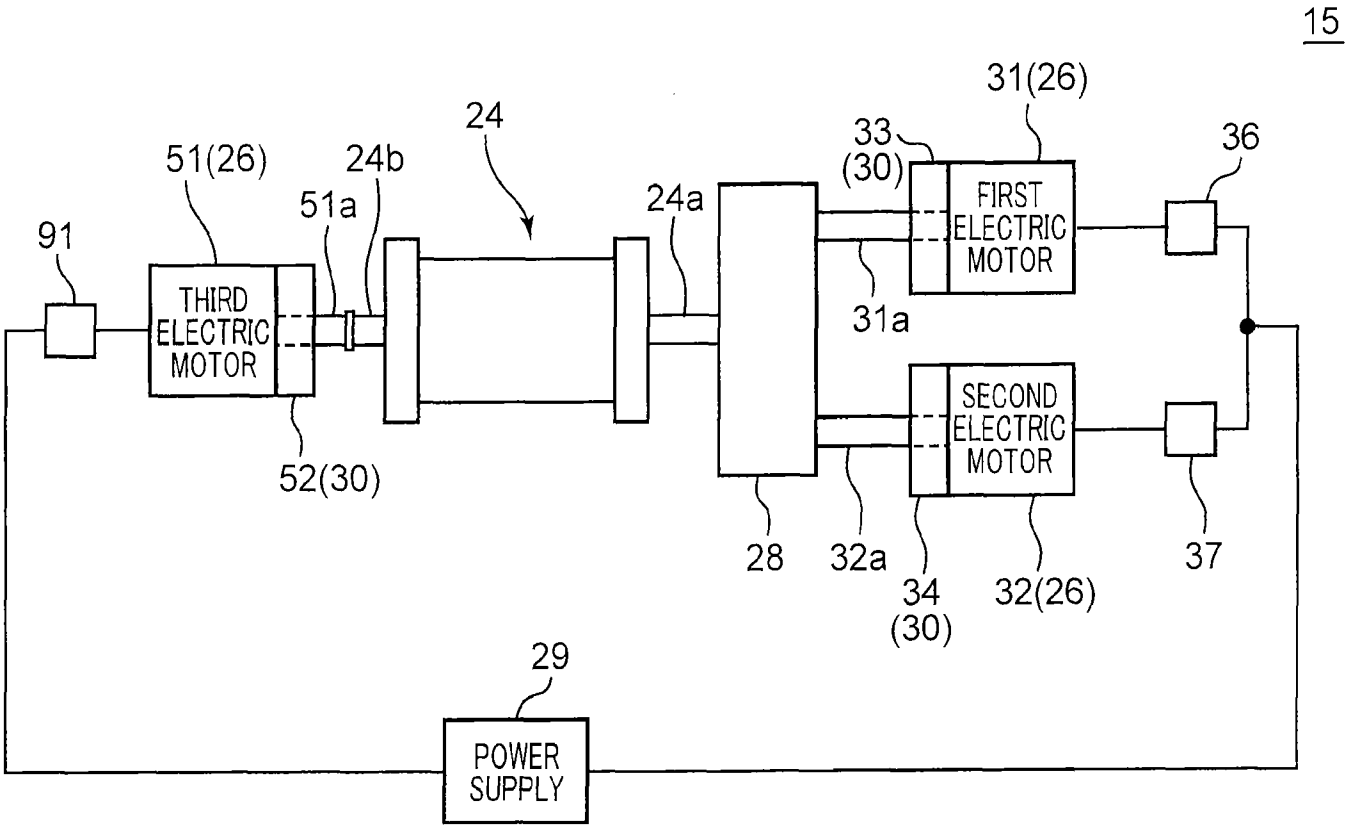
FIG. 10 is a schematic diagram showing the configuration of a winding-up winch of a crane according to a third modification of the embodiment of the present invention.
Figure 11:
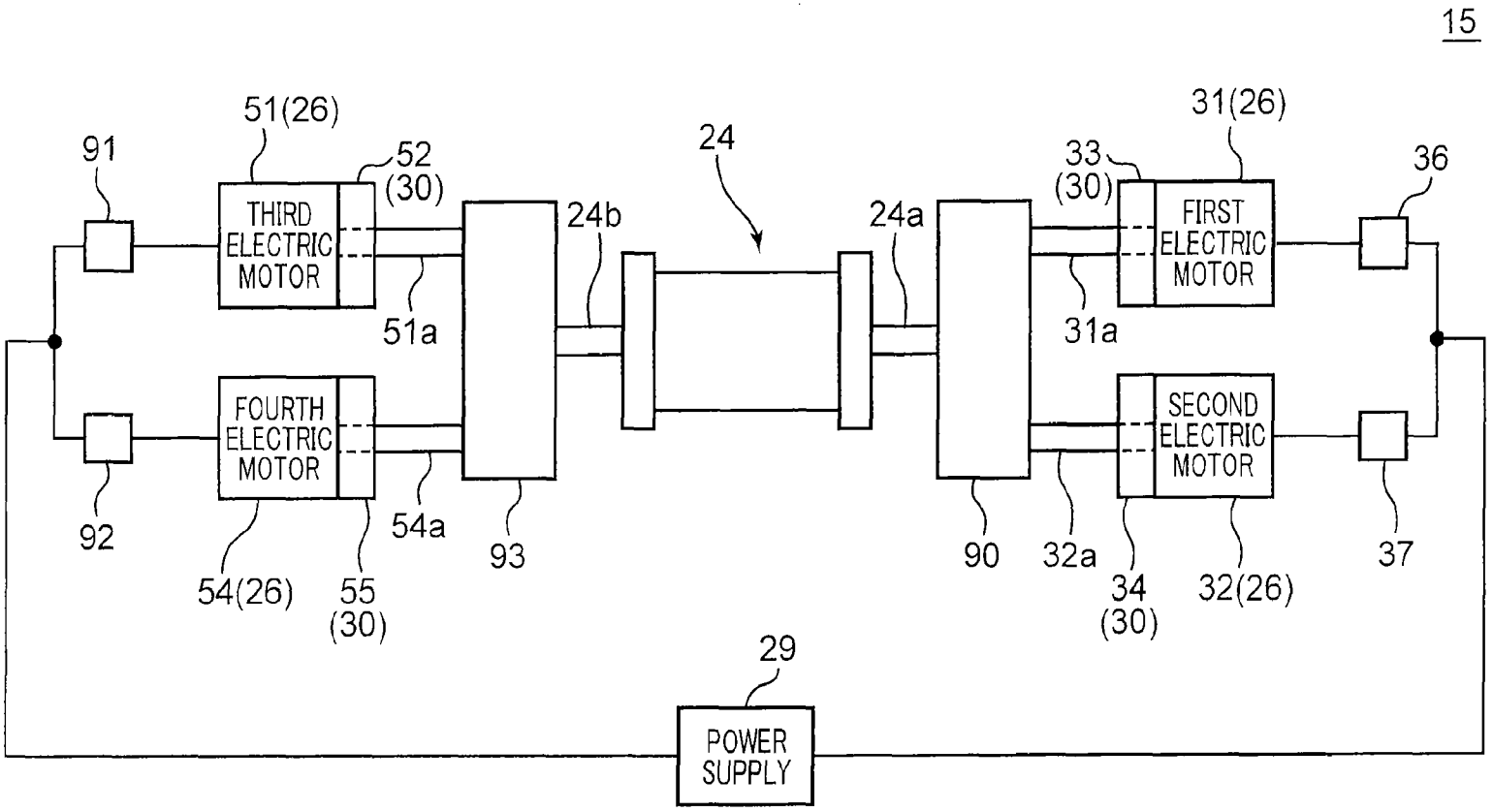
FIG. 11 is a schematic diagram showing the configuration of a winding-up winch of a crane according to a fourth modification of the embodiment of the present invention.

In the present invention, for example, as shown in FIG. 2, all of the plurality of electric motors that output driving torques for rotating the drum may be disposed only on one side of the drum in the axial direction of the drum, which is the direction in which the center axis of the drum extends. However, all of the plurality of the electric motors are not always limited to be disposed in this way. That is, the electric motors may be dividedly disposed on one side and the other side of the drum in the axial direction of the drum. In FIGS. 10 and 11, a winding-up winch including the plurality of electric motors disposed in that way is shown.

Specifically, in FIG. 10, the winding-up winch 15 according to a third modification including three electric motors 26 is shown. The three electric motors 26 include the first electric motor 31, the second electric motor 32, and a third electric motor 51. The first electric motor 31 and the second electric motor 32 are disposed on one side of the drum 24 in the axial direction of the drum 24, which is the direction in which the center axis of the drum 24 extends. The third electric motor 51 is disposed on the opposite side to the first electric motor 31 and the second electric motor 32 with respect to the drum 24 in the axial direction of the drum 24. The first, second, and third electric motors 31, 32, and 51 are operated by supply of electric power from the power supply 29 to output respective driving torques for rotating the drum 24.

In the winding-up winch 15 according to the third modification, the drum 24 includes a first rotating shaft 24*a* extending to one side in the axial direction of the drum 24 and a second rotating shaft 24*b* extending to the opposite side to the first rotating shaft 24*a* in the axial direction of the drum 24. The winding-up winch 15 includes the torque transmitting device 28, the first mechanical brake 33, the second mechanical brake 34, and a third mechanical brake 52. The torque transmitting device 28 is connected to the first rotating shaft 24*a* of the drum 24. Configurations related to the first electric motor 31, the second electric motor 32, the torque transmitting device 28, the first mechanical brake 33, and the second mechanical brake 34 in the winding-up winch 15 in the third modification are the same as the configurations related to the first electric motor 31, the second electric motor 32, the torque transmitting device 28, the first mechanical brake 33, and the second mechanical brake 34 in the winding-up winch 15 in the embodiment.

The third electric motor 51 includes a driving shaft 51 a connected to the second rotating shaft 24*b* of the drum 24. The third electric motor 51 is operated by supply of electric power to rotate the driving shaft 51 a. Consequently, the driving torque output from the third electric motor 51 is input to the drum 24. The third mechanical brake 52 is attached to the third electric motor 51. A configuration related to the third mechanical brake 52 is the same as the configuration related to the first mechanical brake 33.

The first switch 36 is provided on the electric path for supplying electric power from the power supply 29 to the first electric motor 31. The second switch 37 is provided on the electric path for supplying electric power from the power supply 29 to the second electric motor 32. A third switch 91 is provided on an electric path for supplying electric power from the power supply 29 to the third electric motor 51. Configurations related to the first switch 36 and the second switch 37 in the third modification are the same as the configurations related to the first switch 36 and the second switch 37 in the embodiment. The third switch 91 is switched to an ON state for connecting the power supply 29 and the third electric motor 51 and allowing the supply of the electric power from the power supply 29 to the third electric motor 51 and an OFF state for cutting off the connection between the power supply 29 and the third electric motor 51 and stopping the supply of the electric power from the power supply 29 to the third electric motor 51. In the third modification, a failed electric motor is identified out of the first electric motor 31, the second electric motor 32, and the third electric motor 51 as in the example explained above. Control of the third mechanical brake 52 is performed in the same manner as the control of the first mechanical brake 33 in the embodiment. Control of the third switch 91 is performed in the same manner as the control of the first switch 36 in the embodiment. In the third modification, in the display device, concerning the third electric motor 51 in addition to the first and second electric motors 31 and 32, display of an output and maximum torque of specifications, display of an actual output and actual maximum torque in the present state, and display of the normal state and the failure state are performed.

FIG. 11 shows the winding-up winch 15 according to a fourth modification, including four electric motors 26. The four electric motors 26 include the first electric motor 31, the second electric motor 32, the third electric motor 51, and a fourth electric motor 54. The first electric motor 31 and the second electric motor 32 are disposed on one side of the drum 24 in the axial direction of the drum 24. The third electric motor 51 and the fourth electric motor 54 are disposed on the opposite side to the first electric motor 31 and the second electric motor 32 with respect to the drum 24 in the axial direction of the drum 24. The first, second, third, and fourth electric motors 31, 32, 51, and 54 are operated by supply of electric power from the power supply 29 to output respective driving torques for rotating the drum 24.

In the fourth modification, as in the case of the third modification, the drum 24 includes the first rotating shaft 24*a* and the second rotating shaft 24*b*. The winding-up winch 15 in the fourth modification includes a first torque transmitting device 90, a second torque transmitting device 93, the first mechanical brake 33, the second mechanical brake 34, the third mechanical brake 52, and a fourth mechanical brake 55. Configurations related to the first electric motor 31, the second electric motor 32, the first torque transmitting device 90, the first mechanical brake 33, and the second mechanical brake 34 in the winding-up winch 15 in the fourth modification are the same as the configurations of the first electric motor 31, the second electric motor 32, the torque transmitting device 28, the first mechanical brake 33, and the second mechanical brake 34 of the winding-up winch 15 in the embodiment.

The third electric motor 51 includes the driving shaft 51 a connected to the second torque transmitting device 93. The fourth electric motor 54 includes a driving shaft 54*a* connected to the second torque transmitting device 93. The third electric motor 51 is operated by supply of electric power to rotate the driving shaft 51*a*. The fourth electric motor 54 is operated by supply of electric power to rotate the driving shaft 54*a*.

The second torque transmitting device 93 is connected to the second rotating shaft 24*b* of the drum 24. The second torque transmitting device 93 combines the driving torque input from the driving shaft 51 a of the third electric motor 51 and the driving torque input from the driving shaft 54*a* of the fourth electric motor 54 and applies the combined driving torque to the second rotating shaft 24*b* of the drum 24.

The third electric motor 51, the fourth electric motor 54, the second torque transmitting device 93, the third mechanical brake 52, and the fourth mechanical brake 55 are disposed symmetrically to the first electric motor 31, the second electric motor 32, the first torque transmitting device 90, the first mechanical brake 33, and the second mechanical brake 34 across the drum 24. Configurations related to the third electric motor 51, the fourth electric motor 54, the second torque transmitting device 93, the third mechanical brake 52, and the fourth mechanical brake 55 other than the disposition are the same as the configurations related to the first electric motor 31, the second electric motor 32, the torque transmitting device 28, the first mechanical brake 33, and the second mechanical brake 34.

The first switch 36 is provided on the electric path for supplying electric power from the power supply 29 to the first electric motor 31. The second switch 37 is provided on the electric path for supplying electric power from the power supply 29 to the second electric motor 32. The third switch 91 is provided on the electric path for supplying electric power from the power supply 29 to the third electric motor 51. A fourth switch 92 is provided on an electric path for supplying electric power from the power supply 29 to the fourth electric motor 54. Configurations related to the first switch 36 and the second switch 37 in the fourth modification are the same as the configurations related to the first switch 36 and the second switch 37 in the embodiment. A configuration related to the third switch 91 is the same as the configuration related to the third switch 91 in the third modification. The fourth switch 92 is switched to an ON state for connecting the power supply 29 and the fourth electric motor 54 and allowing the supply of the electric power from the power supply 29 to the fourth electric motor 54 and an OFF state for cutting off the connection between the power supply 29 and the fourth electric motor 54 and stopping the supply of the electric power from the power supply 29 to the fourth electric motor 54.

In the fourth modification, a failed electric motor is identified out of the first electric motor 31, the second electric motor 32, the third electric motor 51, and the fourth electric motor 54 as in the example explained above. Control of the first mechanical brake 33 and the second mechanical brake 34 is performed as in the embodiment. Concerning the third mechanical brake 52 and the fourth mechanical brake 55, control same as the control of the first mechanical brake 33 and the second mechanical brake 34 is performed. Control of the first switch 36 and the second switch 37 is performed as in the embodiment. Concerning the third switch 91 and the fourth switch 92, control same as the control of the first switch 36 and the second switch 37 is performed. In the fourth modification, in the display device, concerning the first, second, third, and fourth electric motors 31, 33, 51, and 54, display of an output and maximum torque of specifications, display of an actual output and actual maximum torque in the present state, and display of the normal state or the failure state are respectively performed.

Overview of the Embodiment and the Modifications

The embodiment and the modifications are summarized as follows.

The crane according to the embodiment and the modifications is a crane which performs winding-up and winding-down of a target object, and includes a winch drum configured to rotate for the winding-up and the winding-down of the target object, a plurality of electric motors configured to be operated by supply of electric power to output respective driving torques for rotating the winch drum, a load deriving unit configured to derive a value of a load of the target object, the load being a load applied to the winch drum, an overload safety device configured to monitor the value of the load derived by the load deriving unit and stop an operation of each of the plurality of electric motors when the value of the load exceeds a set hoisting ability value of the crane to stop the rotation of the winch drum, and an identifying unit configured to identify a failed electric motor among the plurality of electric motors. The overload safety device includes a storing unit configured to store the set hoisting ability value, a maximum-load calculating unit configured to calculate a maximum load which the winch drum is capable of winding up with the driving torques output from the remaining electric motors other than the failed electric motor identified by the identifying unit, an updating unit configured to update the set hoisting ability value stored in the storing unit to a value equal to the maximum load calculated by the maximum-load calculating unit, and a control unit configured to perform control of the plurality of electric motors. The control unit performs control for stopping the operation of the failed electric motor identified by the identifying unit, causing the remaining electric motors to operate if the value of the load derived by the load deriving unit is equal to or smaller than a latest set hoisting ability value stored in the storing unit, and stopping the operation of the plurality of electric motors if the value of the load derived by the load deriving unit exceeds the latest set hoisting ability value.

In the crane, if the failed electric motor is identified by the identifying unit, the maximum load that the winch drum is capable of winding up with the driving torques output from the remaining electric motors other than the identified failed electric motor is calculated by the maximum-load calculating unit. The set hoisting ability value stored in the storing unit is updated to a value equal to the maximum load calculated by the maximum-load calculating unit. If the load value derived by the load deriving unit exceeds the latest set hoisting ability value stored in the storing unit, the control unit stops the operation of the electric motors. As a result, the rotation of the winch drum is stopped. Therefore, it is possible to secure certainty of overload prevention at the time when any one of the electric motors fails. On the other hand, if the load value derived by the load deriving unit is equal to or smaller than the latest set hoisting ability value stored in the storing unit, the control unit causes the remaining electric motors other than the failed electric motor to operate. Therefore, it is possible to rotate the winch drum with the driving torques output by the remaining electric motors. That is, although a hoisting ability of the crane is limited compared with the case of a normal state in which none of the electric motors is out of order, it is possible to continuously carry out the hoisting work with a maximum limit hoisting ability in a possible range.

It is preferable that the crane further includes an informing unit configured to inform an operator of the crane that the set hoisting ability value is updated, in response to the update, by the updating unit, of the set hoisting ability value stored in the storing unit.

With this configuration, according to the information by the informing unit, the operator can learn that the update of the set hoisting ability value has been performed. According to the information, the operator can recognize in which of the electric motors a failure occurs. Therefore, it is possible to prevent the operator from forgetting to perform repair and maintenance of the failed electric motor.

In this case, it is preferable that the informing unit is a display device which displays the set hoisting ability value after the update.

With this configuration, viewing the display of the display device, the operator can learn the set hoisting ability value after the update. Therefore, the operator can select hoisting of a target object having a load not exceeding the set hoisting ability value after the update in the hoisting work.

It is preferable that the crane further includes a permission input unit for receiving an input of an instruction for permitting the update of the set hoisting ability value and an update permitting unit configured to grant permission for the update of the set hoisting ability value to the updating unit in response to the input of the instruction to the permission input unit, and the updating unit updates the set hoisting ability value in response to the identifying of the failed electric motor by the identifying unit and the granting of the permission for the update from the update permitting unit.

With this configuration, even if the failed electric motor is identified by the identifying unit, if the operator does not input the instruction for permitting the update of the set hoisting ability value to the permission input unit, the update of the set hoisting ability value stored in the storing unit is not performed. That is, the operator can perform the permission for updating the set hoisting ability value at the operator's own will when the failed electric motor is identified. Therefore, the operator can surely recognize that the set hoisting ability value has been updated.

According to the embodiment and the modifications, even if any one of the plurality of electric motors fails in the crane that rotates the winch drum for the hoisting work with the plurality of electric motors, it is possible to continuously carry out the hoisting work in a possible range while securing certainty of overload prevention.

This application is based on Japanese Patent application No. 2015-040097 and No. 2015-249847 filed in Japan Patent Office on Mar. 2, 2015 and Dec. 22, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A crane which performs winding-up and winding-down of a target object, the crane comprising:

a winch drum configured to rotate for the winding-up and the winding-down of the target object;

a plurality of electric motors configured to be operated by supply of electric power to output respective driving torques for rotating the winch drum;

a load deriving unit configured to derive a value of a load of the target object, the load being a load applied to the winch drum;

an overload safety device configured to monitor the value of the load derived by the load deriving unit and stop an operation of each of the plurality of electric motors when the value of the load exceeds a set hoisting ability value of the crane to stop the rotation of the winch drum; and an identifying unit configured to identify a failed electric motor among the plurality of electric motors, wherein the overload safety device includes:

a storing unit configured to store the set hoisting ability value;

a maximum-load calculating unit configured to calculate a maximum load which the winch drum is capable of winding up with the driving torques output from the remaining electric motors other than the failed electric motor identified by the identifying unit;

an updating unit configured to update the set hoisting ability value stored in the storing unit to a value equal to the maximum load calculated by the maximum-load calculating unit; and a control unit configured to perform control of the plurality of electric motors, and the control unit performs control for stopping the operation of the failed electric motor identified by the identifying unit, causing the remaining electric motors to operate when the value of the load derived by the load deriving unit is equal to or smaller than a latest set hoisting ability value stored in the storing unit, and stopping the operation of the plurality of electric motors when the value of the load derived by the load deriving unit exceeds the latest set hoisting ability value.

2. The crane according to claim 1, further comprising an informing unit configured to inform an operator of the crane that the set hoisting ability value is updated, in response to the update, by the updating unit, of the set hoisting ability value stored in the storing unit.

3. The crane according to claim 2, wherein the informing unit is a display device which displays the set hoisting ability value after the update.

4. The crane according to claim 1, further comprising:

a permission input unit for receiving an input of an instruction for permitting the update of the set hoisting ability value; and an update permitting unit configured to grant permission for the update of the set hoisting ability value to the updating unit in response to the input of the instruction to the permission input unit, wherein the updating unit updates the set hoisting ability value in response to the identifying of the failed electric motor by the identifying unit and the granting of the permission for the update from the update permitting unit.

* * * * *